US010627758B2

(12) United States Patent
Nguyen

(10) Patent No.: US 10,627,758 B2
(45) Date of Patent: Apr. 21, 2020

(54) POWER SUPPLY LOCK STRUCTURE AND IMAGE FORMING APPARATUS

(71) Applicant: KYOCERA Document Solutions Inc., Osaka (JP)

(72) Inventor: Danhchien Nguyen, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/220,581

(22) Filed: Dec. 14, 2018

(65) Prior Publication Data

US 2019/0187596 A1 Jun. 20, 2019

(30) Foreign Application Priority Data

Dec. 18, 2017 (JP) ..... 2017-241877

(51) Int. Cl.

| | |
|---|---|
| ***G03G 15/00*** | (2006.01) |
| ***G03G 21/16*** | (2006.01) |
| ***G03G 15/08*** | (2006.01) |
| *G03G 21/18* | (2006.01) |

(52) U.S. Cl.

CPC ..... *G03G 15/5004* (2013.01); *G03G 15/0865* (2013.01); *G03G 15/5016* (2013.01); *G03G 15/80* (2013.01); *G03G 21/1633* (2013.01); *G03G 21/1676* (2013.01); *G03G 21/181* (2013.01); *G03G 21/1821* (2013.01)

(58) Field of Classification Search

CPC ..... G03G 15/5004; G03G 15/0865; G03G 21/1633; G03G 21/1676

See application file for complete search history.

(56) References Cited

U.S. PATENT DOCUMENTS

| | | | | |
|---|---|---|---|---|
| 9,778,597 | B2 | 10/2017 | Eto | |
| 2006/0177237 | A1* | 8/2006 | Kim | G03G 21/1647 399/107 |
| 2011/0129250 | A1* | 6/2011 | Kondo | G03G 21/1619 399/107 |
| 2017/0075256 | A1 | 3/2017 | Eto | |
| 2017/0075258 | A1 | 3/2017 | Eto | |

FOREIGN PATENT DOCUMENTS

| | | | |
|---|---|---|---|
| DE | 10 2011 088 745 | A1 | 6/2013 |
| JP | 2008-021436 | A | 1/2008 |
| JP | 2009-265571 | A | 11/2009 |
| JP | 2017-054023 | A | 3/2017 |

OTHER PUBLICATIONS

The extended European search report issued by the European Patent Office dated Mar. 14, 2019, which corresponds to European Patent Application No. 18212989.0—1022 and is related to U.S. Appl. No. 16/220,581.

* cited by examiner

*Primary Examiner* — Hoang X Ngo

(74) *Attorney, Agent, or Firm* — Studebaker & Brackett PC

(57) ABSTRACT

An image forming apparatus includes an image forming section and a power supply lock structure. The image forming section forms an image on paper. The power supply lock structure includes a power button and a locking mechanism. The power button switches a power supply between on and off. The locking mechanism prohibits operation of the power button. The locking mechanism is located on a front cover. Prohibition of the operation of the power supply is releasable by the locking mechanism only when the front cover is open.

8 Claims, 17 Drawing Sheets

POWER SUPPLY LOCK STRUCTURE AND IMAGE FORMING APPARATUS

INCORPORATION BY REFERENCE

The present application claims priority under 35 U.S.C. § 119 to Japanese Patent Application No. 2017-241877, filed on Dec. 18, 2017. The contents of this application are incorporated herein by reference in their entirety.

BACKGROUND

The present disclosure relates to a power supply lock structure and an image forming apparatus.

An example of an image forming apparatus includes a casing, a development device, and a toner container. The casing includes a front cover. The development device includes a toner replenishment port. When the front cover is open, the development device is detachable from the casing through an insertion path after moving to a standby position. The standby position is a position in which the development device has been rotated in a first direction from a development position around a first axis that is parallel to a rotary shaft of a photosensitive drum. In a state in which the front cover is open and the development device is in the development position or the standby position, the toner container is detachable from the casing through the insertion path after rotating in a second direction around a second axis. The second axis is parallel to the first axis. The second direction is opposite to the first direction.

Therefore, in the above image forming apparatus, the development device and the toner container can be easily detached from the casing. When being manufactured and transported, the image forming apparatus is arranged in a posture in which toner is not supplied from the toner container. Therefore, a user must open a cover and change the posture of the toner container so that toner can be supplied from the toner container. When being transported, operating instructions describing operation steps for the user to put the transported image forming apparatus into a usable state are affixed to the image forming apparatus.

SUMMARY

A power supply lock structure according to an aspect of the present disclosure includes a power button and a locking mechanism. The power button switches a power supply between on and off. The locking mechanism prohibits operation of the power button. The locking mechanism is located on a cover. Prohibition of the operation of the power supply is releasable by the locking mechanism only when the cover is open.

An image forming apparatus according to an aspect of the present disclosure includes a power supply lock structure, an image forming section, and a casing. The image forming section forms an image on a recording medium. The casing includes a cover and houses the image forming section. The power supply lock structure includes a power button and a locking mechanism. The power button switches a power supply between on and off. The locking mechanism prohibits operation of the power supply by the power button. The locking mechanism is located on the cover. Prohibition of the operation of the power supply is releasable by the locking mechanism only when the cover is open.

DETAILED DESCRIPTION

Figure 1:
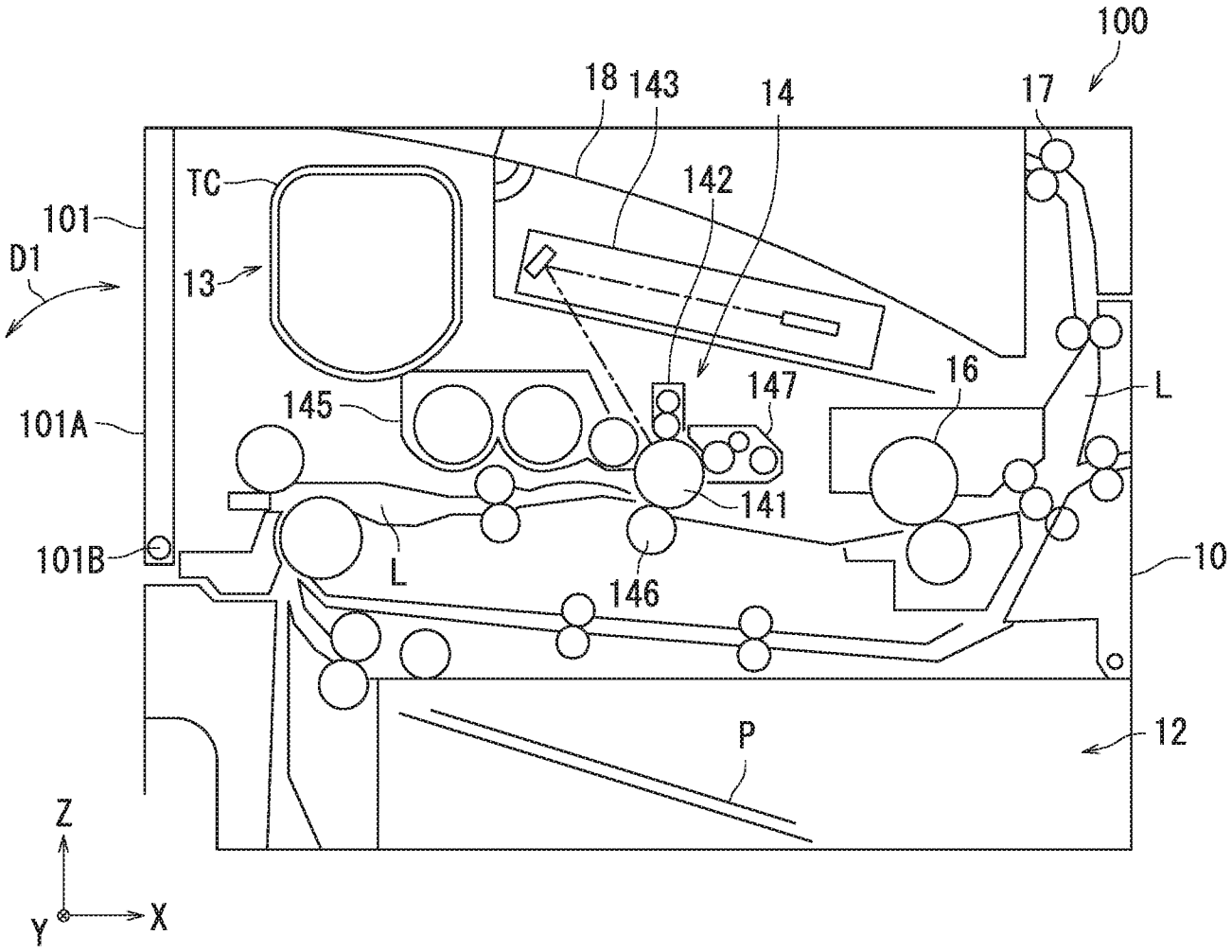
FIG. 1 is a diagram illustrating a configuration of an image forming apparatus according to an embodiment of the present disclosure.

In the following, an embodiment of the present disclosure is described with reference to the accompanying drawings (FIGS. 1 to 17B). Note that elements that are the same or equivalent are labelled with the same reference signs in the drawings and description thereof is not repeated.

First, an image forming apparatus 100 according to the embodiment of the present disclosure is described with reference to FIGS. 1 and 2. FIG. 1 is a diagram illustrating a configuration of the image forming apparatus 100. As illustrated in FIG. 1, the image forming apparatus 100 is a printer.

Mutually orthogonal X, Y, and Z axes are shown in FIG. 1. The X and Y axes are parallel to a horizontal plane. The Z axis is parallel to a vertical direction. In the following description, a positive X axis direction may be considered backward, and a negative X axis direction may be considered forward.

The image forming apparatus 100 includes a casing 10, a feeding section 12, a conveyance section L, a toner supply section 13, an image forming section 14, a fixing section 16, an ejection roller pair 17, and an exit tray 18. The casing 10 houses the feeding section 12, the conveyance section L, the toner supply section 13, the image forming section 14, the fixing section 16, and the ejection roller pair 17.

The feeding section 12 feeds paper P to the conveyance section L. The conveyance section L conveys the paper P to the ejection roller pair 17 by way of the image forming section 14 and the fixing section 16.

A toner container TC is attached to the toner supply section 13. The toner container TC supplies toner to the image forming section 14.

The image forming section 14 includes a photosensitive drum 141, a charger 142, a light exposure section 143, a development section 145, a transfer roller 146, and a cleaning section 147.

The charger 142 charges the photosensitive drum 141 to a predetermined potential. The light exposure section 143 radiates laser light to expose the photosensitive drum 141 to the laser light, thus forming an electrostatic latent image on the photosensitive drum 141. The development section 145 supplies toner to the photosensitive drum 141, thus developing the electrostatic latent image into a toner image. In this manner, a toner image is formed on a peripheral surface of the photosensitive drum 141. The transfer roller 146 transfers the toner image from the photosensitive drum 141 to the paper P. As a result, an image is formed on the paper P. The cleaning section 147 removes remaining toner from the peripheral surface of the photosensitive drum 141.

The paper P with the image formed thereon is conveyed to the fixing section 16. The fixing section 16 applies heat and pressure to the paper P, thus fixing the image formed on the paper P to the paper P. The paper P with the image fixed thereon is ejected to the exit tray 18 by the ejection roller pair 17.

The casing 10 includes a front cover 101. The front cover 101 is open in attachment and detachment of the toner container TC. The front cover 101 includes a cover main body 101A and a support shaft 101B. The support shaft 101B is a cylindrical member extending in a Y axis direction. The support shaft 101B rotatably supports the cover main body 101A. The cover main body 101A is flatly plate-shaped and is configured to rotate in a direction D1 as indicated by an arrow D1 about the support shaft 101B serving as a fulcrum thereof. The front cover 101 is equivalent to an example of a "cover".

Figure 2:
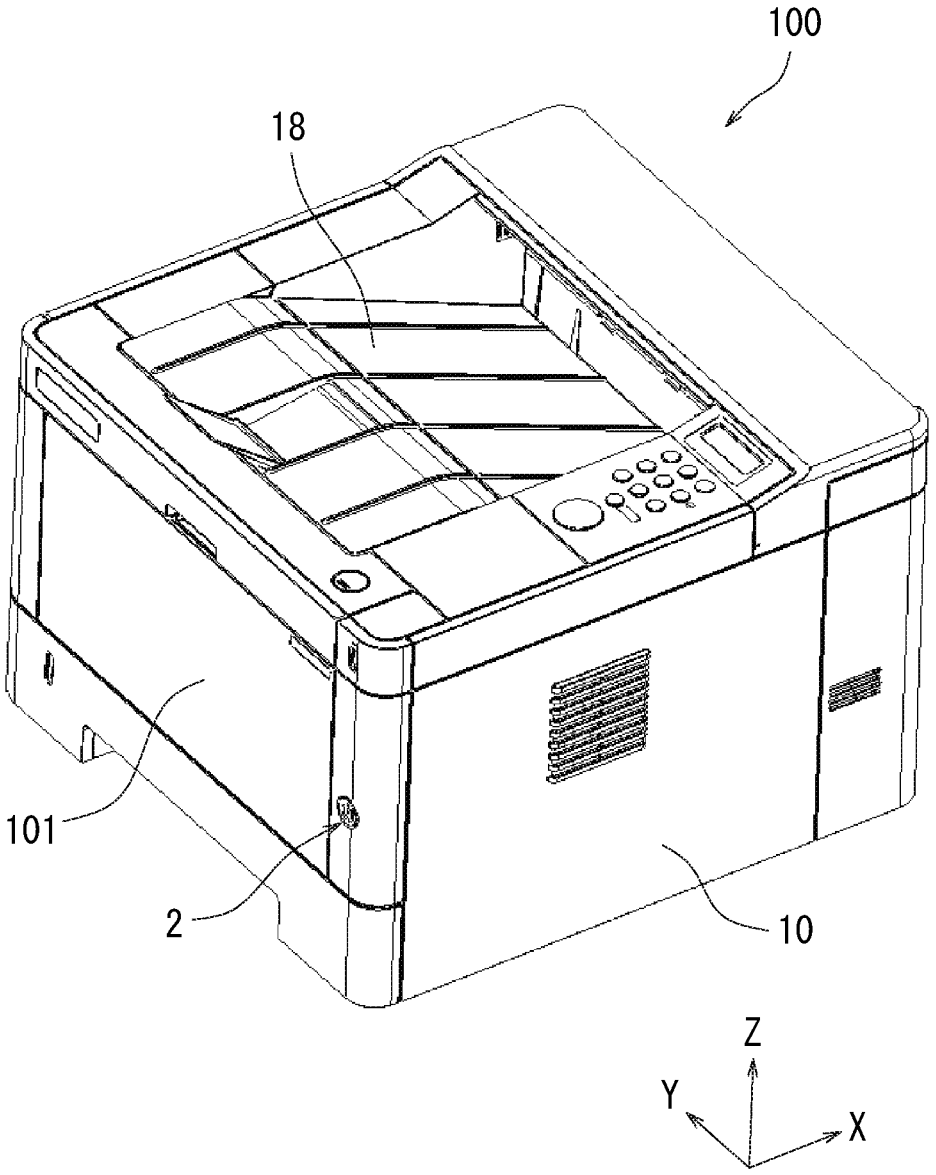
FIG. 2 is a perspective view illustrating the configuration of the image forming apparatus.

FIG. 2 is a perspective view illustrating the configuration of the image forming apparatus 100. As illustrated in FIG. 2, the image forming apparatus 100 further includes a power supply lock structure 2. The power supply lock structure 2 is located on an end of the front cover 101 in a negative Y axis direction.

Figure 3:
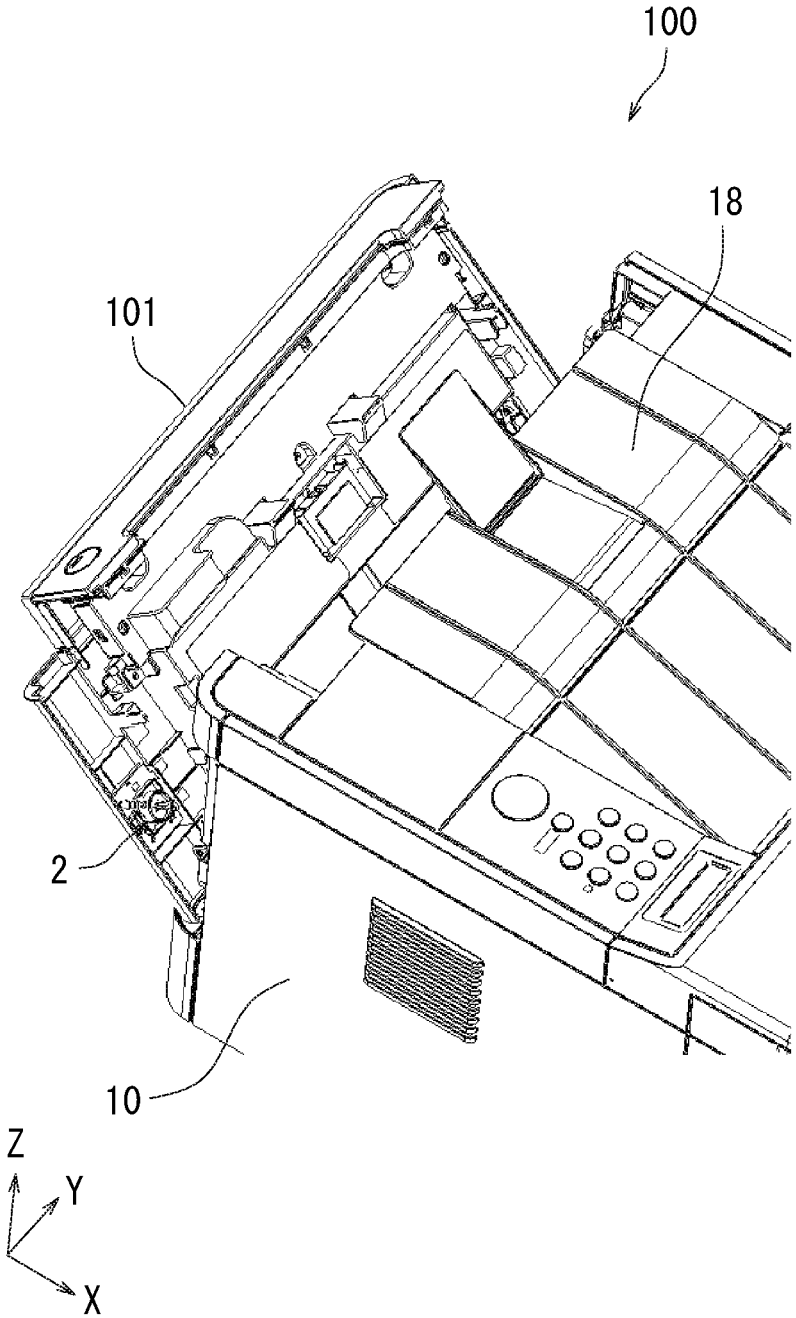
FIG. 3 is a perspective view illustrating an arrangement of a power supply lock structure according to the embodiment of the present disclosure.

Next, an arrangement of the power supply lock structure 2 according to the embodiment of the present disclosure is described with reference to FIGS. 1 to 3. FIG. 3 is a perspective view illustrating the arrangement of the power supply lock structure 2. In FIG. 3, the front cover 101 is open. As illustrated in FIG. 3, the power supply lock structure 2 is located on a back surface of the front cover 101.

Figure 4:
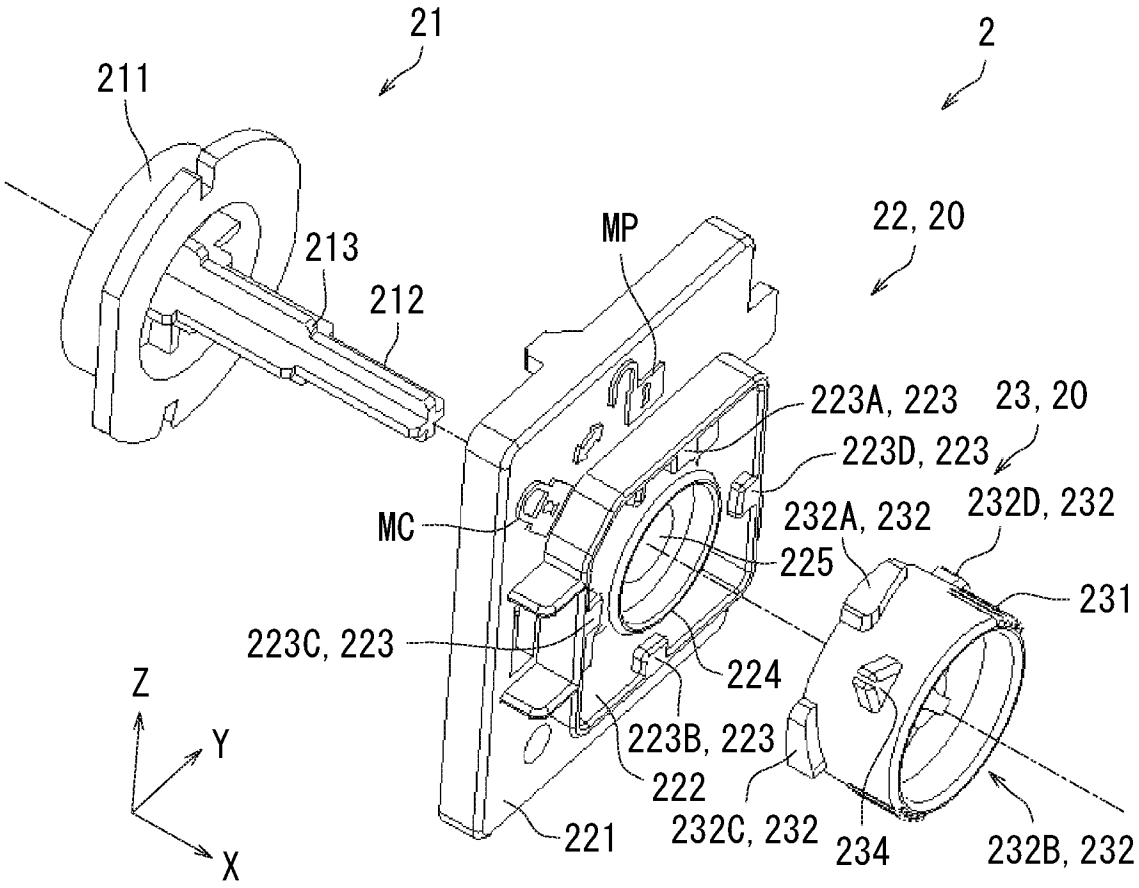
FIG. 4 is an exploded perspective view illustrating a configuration of the power supply lock structure.

Next, a configuration of the power supply lock structure 2 is described with reference to FIGS. 1 to 4. FIG. 4 is an exploded perspective view illustrating the configuration of the power supply lock structure 2. As illustrated in FIG. 4, the power supply lock structure 2 includes a power button 21 and a locking mechanism 20. The locking mechanism 20 includes a supporting member 22 and a rotary member 23.

The power button 21 has a button 211 and a shaft member 212. The button 211 is disk-shaped and is pressed by a user when power is switched on or off. The button 211 is exposed on a front surface of the front cover 101. That is, the user can press the button 211 to switch a power supply between on and off when the front cover 101 is closed. The front surface faces in the negative X axis direction and is equivalent to an "obverse surface".

The shaft member 212 supports the button 211. The shaft member 212 extends in an X axis direction. That is, an axial direction of the shaft member 212 is parallel to the X axis. A cross section of the shaft member 212 in a direction perpendicular to the axial direction of the shaft member 212 is cross-shaped. The direction perpendicular to the axial direction of the shaft member 212 is a direction parallel to a Y-Z plane.

The shaft member 212 is inserted through the supporting member 22 and the rotary member 23. The shaft member 212 has a stepped portion 213. In the stepped portion 213, the shaft member 212 is tapered in the positive X axis direction. That is, in the stepped portion 213, a size of the cross section in a direction perpendicular to the axial direction of the shaft member 212 decreases in steps in the positive X axis direction. The stepped portion 213 is in contact with the rotary member 23.

The locking mechanism 20 prohibits movement of the shaft member 212 in the axial direction of the shaft member 212. The locking mechanism 20 is located on the back surface of the front cover 101. Therefore, the locking mechanism 20 can release prohibition of operation of the power supply only when the front cover 101 is open. The back surface faces in the positive X axis direction and is equivalent to a "reverse surface".

The supporting member 22 is secured to the front cover 101 and rotatably supports the rotary member 23. The supporting member 22 includes a base member 221, a first guide member 222, and a second guide member 224. The base member 221 is rectangular plate-shaped. The base member 221 has a lock displaying section MC, an unlock displaying section MP, and an insertion hole 225.

The lock displaying section MC and the unlock displaying section MP are located on a back surface of the base member 221. A mark of a locked padlock is displayed on the lock displaying section MC. A mark of an unlocked padlock is displayed on the unlock displaying section MP.

The insertion hole 225 is a round hole formed in a central portion of the base member 221. The shaft member 212 is inserted through the insertion hole 225.

The first guide member 222 is a hollow rectangular prism-shaped member erected on the base member 221 in the positive X axis direction. A portion of the rotary member 23 is inserted into the first guide member 222. The first guide member 222 includes four protruding members 223. Each of the four protruding members 223 is a plate-shaped member erected inward on an end of the first guide member 222 in the positive X axis direction. The four protruding members 223 include a first protruding member 223A, a second protruding member 223B, a third protruding member 223C, and a fourth protruding member 223D.

The first protruding member 223A is located on a side of the first guide member 222 in a positive Z axis direction. The second protruding member 223B is located on a side of the first guide member 222 in a negative Z axis direction. The third protruding member 223C is located on a side of the first guide member 222 in the negative Y axis direction. The fourth protruding member 223D is located on a side of the first guide member 222 in a positive Y axis direction. The first protruding member 223A and the second protruding member 223B are located opposite to each other. The third protruding member 223C and the fourth protruding member 223D are located opposite to each other.

The second guide member 224 is a cylindrical member erected on the base member 221 in the positive X axis direction. The second guide member 224 is located between the insertion hole 225 and the first guide member 222. A portion of the rotary member 23 is inserted between the second guide member 224 and the first guide member 222.

The rotary member 23 is cylindrical and is rotatably supported by the supporting member 22. Specifically, an end of the rotary member 23 in the negative X axis direction is in contact with a surface of the base member 221 of the supporting member 22 in the positive X axis direction. The rotary member 23 includes a grip section 231, four engaging members 232, and an indicating member 234.

The grip section 231 has a plurality of grooves on a side of the rotary member 23 in the positive X axis direction. Specifically, each of the grooves composing the grip section 231 linearly extends in the X axis direction in an outer peripheral surface of the rotary member 23. The grip section 231 is gripped by the user rotating the rotary member 23.

Each of the four engaging members 232 is a rectangular plate-shaped member erected on the end of the rotary member 23 in the negative X axis direction. Each of the four engaging members 232 is erected outward on the outer peripheral surface of the rotary member 23. That is, each of the four engaging members 232 is erected in a direction away from a central axis of the rotary member 23.

The four engaging members 232 include a first engaging member 232A, a second engaging member 232B, a third engaging member 232C, and a fourth engaging member 232D. The first engaging member 232A engages with the first protruding member 223A. The second engaging member 232B engages with the second protruding member 223B. The third engaging member 232C engages with the third protruding member 223C. The fourth engaging member 232D engages with the fourth protruding member 223D.

When the first engaging member 232A engages with the first protruding member 223A, the second engaging member 232B engages with the second protruding member 223B, the third engaging member 232C engages with the third protruding member 223C, and the fourth engaging member 232D engages with the fourth protruding member 223D. That is, the four engaging members 232 respectively engage with the four protruding members 223 at the same time. The four engaging members 232 also respectively release engagement from the four protruding members 223 at the same time.

Specifically, when the rotary member 23 is in a "first rotational position", the four engaging members 232 engage with the respective four protruding members 223. When the rotary member 23 is in a "second rotational position", the four engaging members 232 are released from engagement with the respective four protruding members 223.

The first rotational position and the second rotational position are described later in detail with reference to FIG. 5. In the following description, the four engaging members 232 engaging with the respective four protruding members 223 may be simply referred to as "the engaging members 232 engaging with the protruding members 223". Also, the four engaging members 232 releasing from engagement with the respective four protruding members 223 may be simply referred to as "the engaging members 232 being released from engagement with the protruding members 223".

Movement of the shaft member 212 in the axial direction of the shaft member 212 is prohibited by the engaging members 232 engaging with the protruding members 223, thus prohibiting operation of the power button 21. Also, prohibition of movement of the shaft member 212 in the axial direction of the shaft member 212 is released by the engaging members 232 being released from engagement with the protruding members 223, thus releasing prohibition of the operation of the power button 21.

The indicating member 234 indicates whether the rotary member 23 is in the first rotational position or the second rotational position. The indicating member 234 is a triangular plate-shaped member erected on a central portion of the rotary member 23 in the X axis direction. When a distal end of the indicating member 234 is in a position opposite to the lock displaying section MC, the indicating member 234 indicates that the rotary member 23 is in the first rotational position. When the distal end of the indicating member 234 is in a position opposite to the unlock displaying section MP, the indicating member 234 indicates that the rotary member 23 is in the second rotational position. The indicating member 234, the lock displaying section MC, and the unlock displaying section MP constitute an example of a "first displaying member".

As described above with reference to FIGS. 1 to 4, the locking mechanism 20 is located on the front cover 101 and can release prohibition of the operation of the power supply only when the front cover 101 is open. Therefore, it is necessary to open the front cover 101 for turning on the power. Accordingly, the user can be led to open the front cover 101.

Because the locking mechanism 20 is located on the reverse surface of the front cover 101, the locking mechanism 20 can release prohibition of the operation of the power supply only when the front cover 101 is open. Specifically, the user can rotate the rotary member 23 from the first rotational position to the second rotational position only when the front cover 101 is open. Accordingly, the user can be led to open the front cover 101.

Furthermore, the power button 21 is located on the obverse surface of the front cover 101. Therefore, the user can switch the power supply between on and off with the front cover 101 closed when the prohibition of the operation of the power supply is released. Accordingly, convenience for the user can be improved.

The power button 21 includes the shaft member 212 which supports the button 211, and the locking mechanism 20 prohibits movement of the shaft member 212 in the axial direction of the shaft member 212. Accordingly, the operation of the power supply can be prohibited with a simple configuration.

Note that the cover is the front cover 101 in the embodiment of the present disclosure, but the present disclosure is not limited as such. It is only required that the cover be located on the casing 10. For example, the cover may be an upper cover located on an upper surface of the casing 10.

Also the locking mechanism 20 is located on the reverse surface of the front cover 101 in the embodiment of the present disclosure, but the present disclosure is not limited as such. It is only required that the locking mechanism 20 be located on the front cover 101 and be capable of releasing prohibition of the operation of the power supply only when the front cover 101 is open. For example, the locking mechanism 20 may be located on an upper end of the front cover 101 and be hidden by an upper cover when the front cover 101 is closed.

Furthermore, the first guide member 222 includes the four protruding members 223 and the rotary member 23 includes the four engaging members 232 in the embodiment of the present disclosure, but the present disclosure is not limited as such. It is only required that the first guide member 222 include at least one protruding member 223 and the rotary member 23 include at least one engaging member 232. For example, the first guide member 222 may have two protruding members 223 and the rotary member 23 may have two engaging members 232.

Next, the first rotational position and the second rotational position are described with reference to FIGS. 3 to 5. FIG. 5 is a front view of the locking mechanism 20 as seen from behind the front cover 101. As illustrated in FIG. 5, the distal end of the indicating member 234 is in a position opposite to the lock displaying section MC. That is, the indicating member 234 points to the lock displaying section MC. The first rotational position is a position of the rotary member 23 in a rotational direction in which the indicating member 234 points to the lock displaying section MC. When the rotary member 23 is in the first rotational position, the engaging members 232 engage with the protruding members 223 and prohibit movement of the shaft member 212 in the axial direction of the shaft member 212. As a result, the operation of the power supply is prohibited.

The user can move the rotary member 23 from the first rotational position to the second rotational position by gripping the grip section 231 of the rotary member 23 and rotating the rotary member 23 clockwise as indicated by a direction D2. The second rotational position is a position of the rotary member 23 in the rotational direction in which the indicating member 234 points to the unlock displaying section MP. When the rotary member 23 is in the second rotational position, the engaging members 232 is released from engagement with the protruding members 223, thus releasing prohibition of movement of the shaft member 212 in the axial direction of the shaft member 212. As a result, prohibition of the operation of the power supply is released.

The rotary member 23 further includes a plate member 233. The plate member 233 is a disk-shaped member secured to an inner peripheral surface of the rotary member 23. The plate member 233 is arranged parallel to the Y-Z plane. The plate member 233 has an insertion hole 235.

The insertion hole 235 is a hole formed in a central portion of the plate member 233. The insertion hole 235 includes a center hole 235A and four peripheral holes 235B. The center hole 235A is a round hole formed in the central portion of the plate member 233. Each of the four peripheral holes 235B is a rectangular hole communicating with the center hole 235A and protruding away from the center of the center hole 235A. An angle between two line segments connecting the centers of two adjacent among the four peripheral holes 235B with the center of the center hole 235A is 90°.

The shaft member 212 is inserted through the insertion hole 235. The stepped portion 213 of the shaft member 212 is in contact with a surface of the plate member 233 in the negative X axis direction. Specifically, the stepped portion 213 of the shaft member 212 makes contact with a surface of the plate member 233 in the negative X-axis direction on a peripheral edge of each of the four peripheral holes 235B in a direction away from the center of the center hole 235A. When the shaft member 212 moves in the axial direction of the shaft member 212, the shaft member 212 moves together with the rotary member 23.

In the embodiment of the present disclosure as described above with reference to FIGS. 3 to 5, the indicating member 234, the lock displaying section MC, and the unlock displaying section MP indicate whether the rotary member 23 is in the first rotational position or the second rotational position. When the rotary member 23 is in the first rotational position, the operation of the power supply is prohibited. When the rotary member 23 is in the second rotational position, the prohibition of the operation of the power supply is released. Accordingly, the user can easily release the prohibition of the operation of the power supply.

Next, the configuration of the locking mechanism 20 is further described with reference to FIGS. 3 to 8. FIG. 6 is a cross-sectional view of the locking mechanism 20 illustrated in FIG. 5 taken along a line VI-VI. As illustrated in FIG. 6, the first engaging member 232A of the rotary member 23 engages with the first protruding member 223A of the first guide member 222. That is, the rotary member 23 is in the first rotational position.

Figure 5:
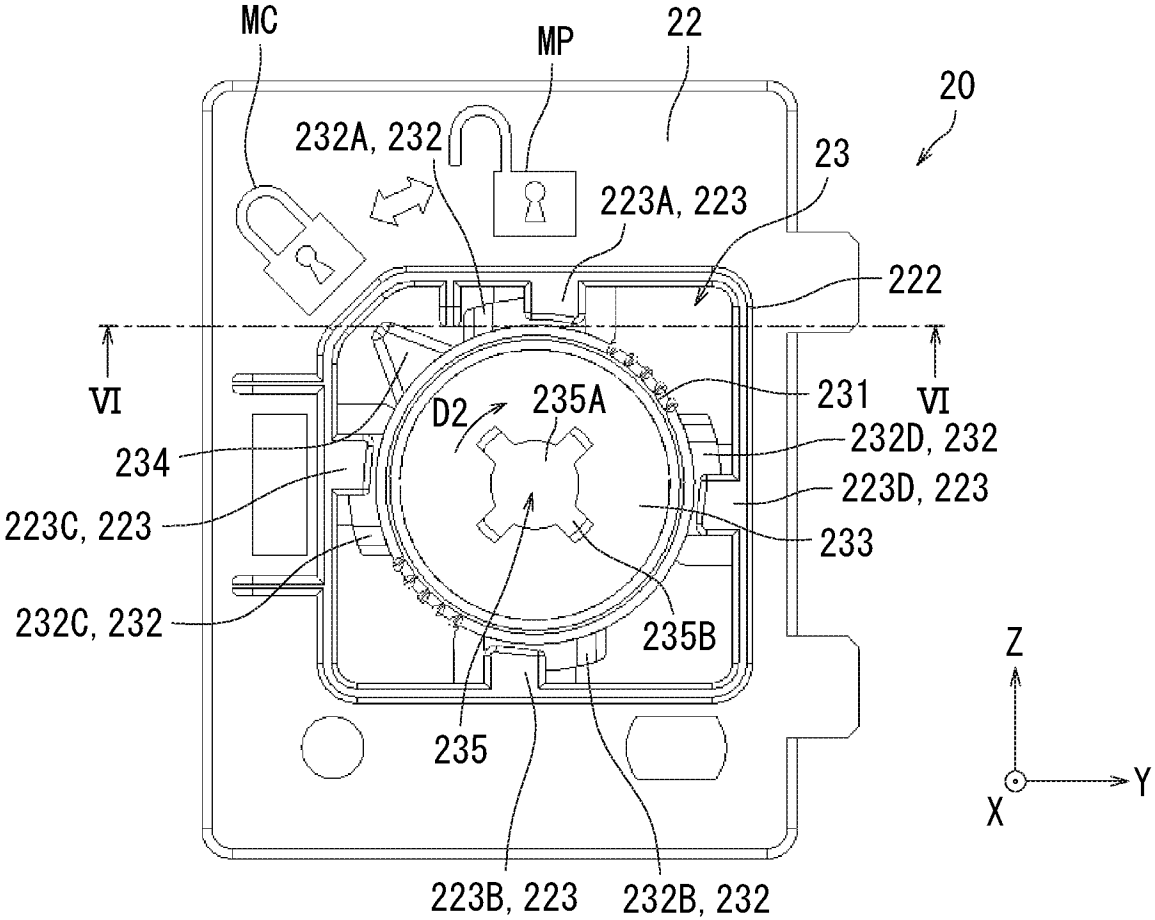
FIG. 5 is a front view of a locking mechanism as seen from behind a front cover.
Figure 6:
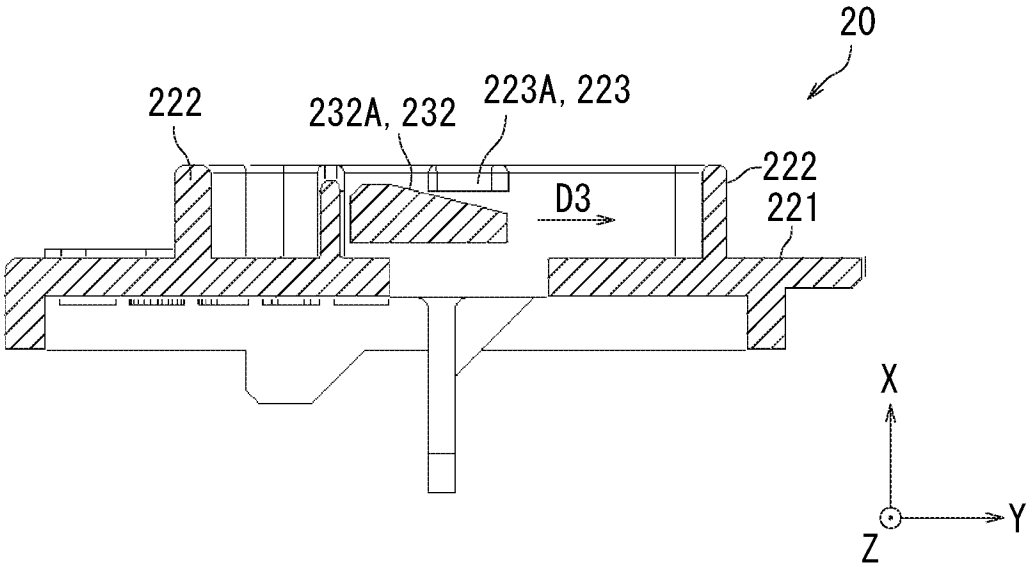
FIG. 6 is a cross-sectional view of the locking mechanism illustrated in FIG. 5 taken along a line VI-VI.

The first engaging member 232A moves in a direction D3 due to the user gripping the grip section 231 of the rotary member 23 and rotating the rotary member 23 clockwise as indicated by the direction D2 illustrated in FIG. 5. As a result, the first engaging member 232A is released from engagement with the first protruding member 223A. That is, the first engaging member 232A is released from engagement with the first protruding member 223A due to the rotary member 23 rotating from the first rotational position to the second rotational position.

Figure 7:
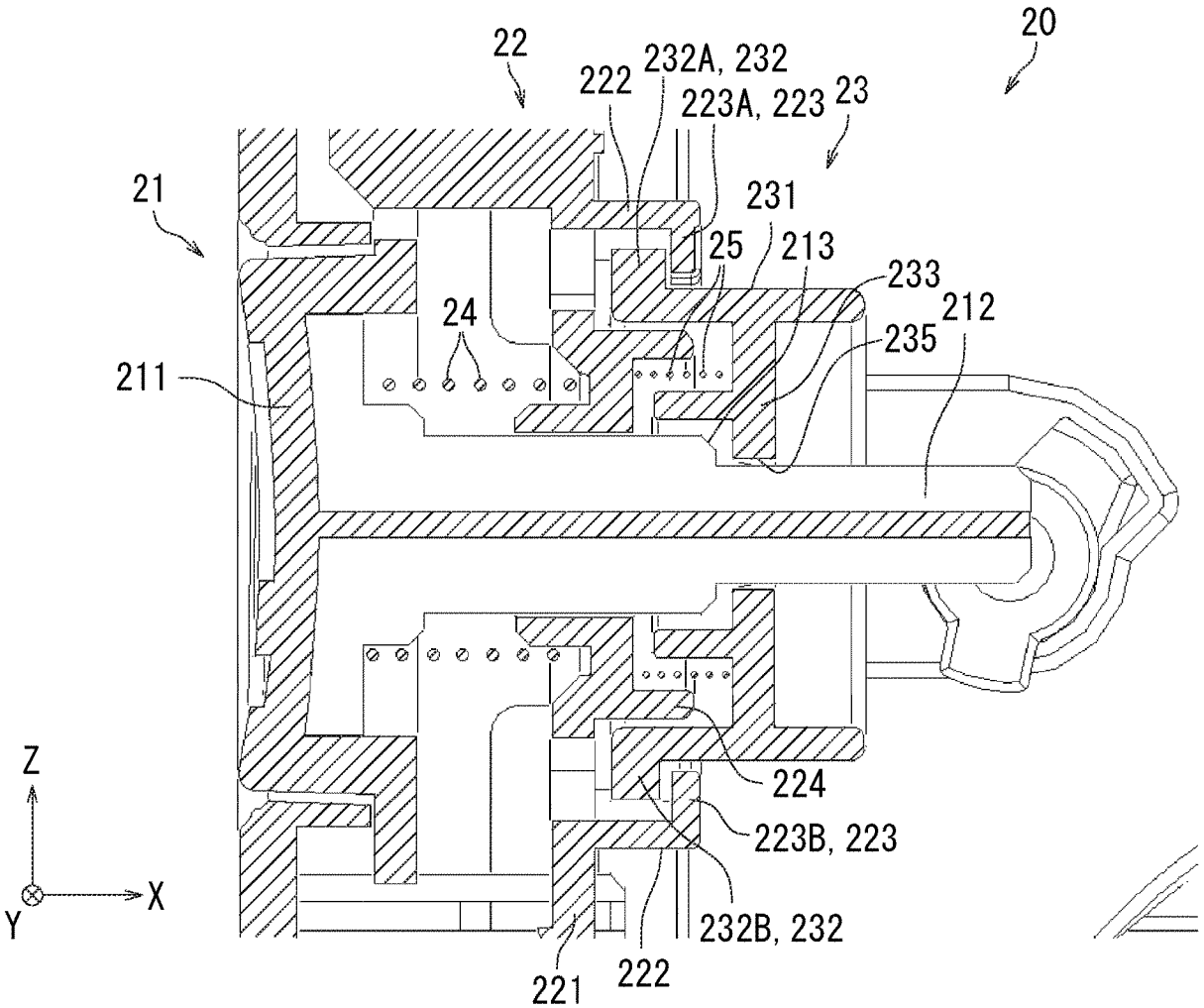
FIG. 7 is a cross-sectional view illustrating the locking mechanism in a locked state.

FIG. 7 is a cross-sectional view illustrating the locking mechanism 20 in a locked state. As illustrated in FIG. 7, the first engaging member 232A of the rotary member 23 engages with the first protruding member 223A of the first guide member 222, and the second engaging member 232B of the rotary member 23 engages with the second protruding member 223B of the first guide member 222. As a result, the locking mechanism 20 prohibits movement of the shaft member 212 in the axial direction of the shaft member 212. Specifically, the stepped portion 213 of the shaft member 212 makes contact with the plate member 233, thus prohibiting movement of the shaft member 212 in the axial direction of the shaft member 212. That is, the prohibition of the operation of the power supply is released.

As illustrated in FIG. 7, the locking mechanism 20 further includes a first urging member 24 and a second urging member 25. The first urging member 24 in a compressed state is located between the button 211 of the power button 21 and the base member 221 of the supporting member 22. The first urging member 24 is for example a coil spring. The "compressed state" means a state in which a length of the coil spring is shorter than a natural length thereof. The shaft member 212 is inserted through the first urging member 24. The first urging member 24 urges the button 211 in the negative X axis direction.

The second urging member 25 in an extended state is located between the base member 221 of the supporting member 22 and the plate member 233 of the rotary member 23. An end of the second urging member 25 in the negative X axis direction is secured to the base member 221, and an end of the second urging member 25 in the positive X axis direction is secured to the plate member 233. The second urging member 25 is for example a coil spring. The "extended state" means a state in which a length of the coil spring is longer than the natural length thereof. The shaft member 212 is inserted through the second urging member 25. The second urging member 25 urges the rotary member 23 in the negative X axis direction.

Figure 8:
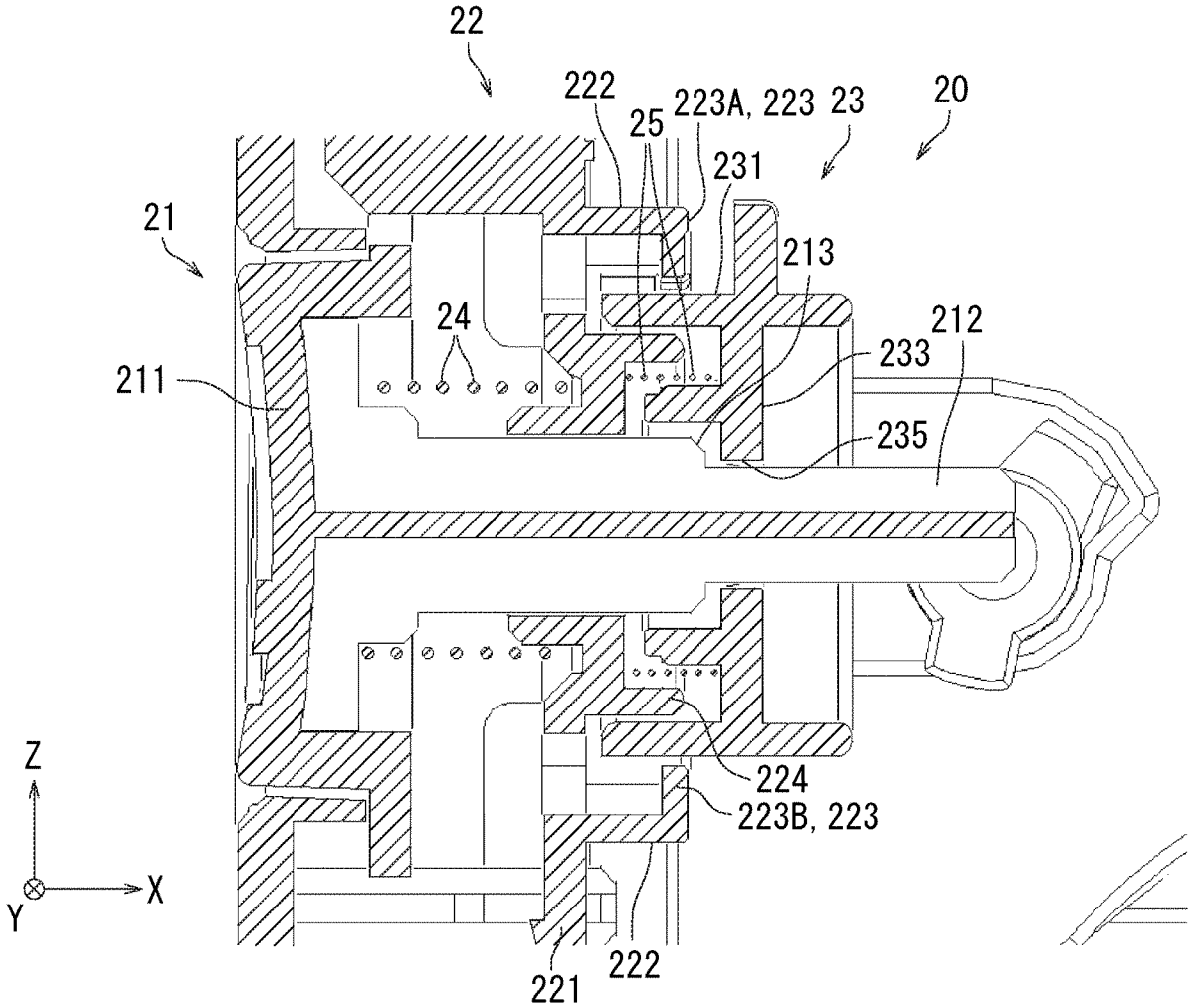
FIG. 8 is a cross-sectional view illustrating the locking mechanism in an unlocked state.

FIG. 8 is a cross-sectional view illustrating the locking mechanism 20 in an unlocked state. As illustrated in FIG. 8, the first engaging member 232A of the rotary member 23 is released from engagement with the first protruding member 223A of the first guide member 222, and the second engaging member 232B of the rotary member 23 is released from engagement with the second protruding member 223B of the first guide member 222. As a result, the locking mechanism 20 releases the prohibition of movement of the shaft member 212 in the axial direction of the shaft member 212. Specifically, when the button 211 is pressed, the stepped portion 213 of the shaft member 212 makes contact with the plate member 233 and the shaft member 212 moves in the positive X axis direction together with the rotary member 23. That is, the prohibition of the operation of the power supply is released.

In the embodiment of the present disclosure as described above with reference to FIGS. 3 to 8, movement of the shaft member 212 in the axial direction of the shaft member 212 is prohibited by the engaging members 232 of the rotary member 23 engaging with the protruding members 223 of the supporting member 22. Engagement of the engaging members 232 with the protruding members 223 is released by the rotary member 23 rotating from the first rotational position to the second rotational position. Therefore, prohibition of the operation of the power supply can be released by rotating the rotary member 23. Accordingly, prohibition of the operation of the power supply can be released with a simple operation.

Figure 9:
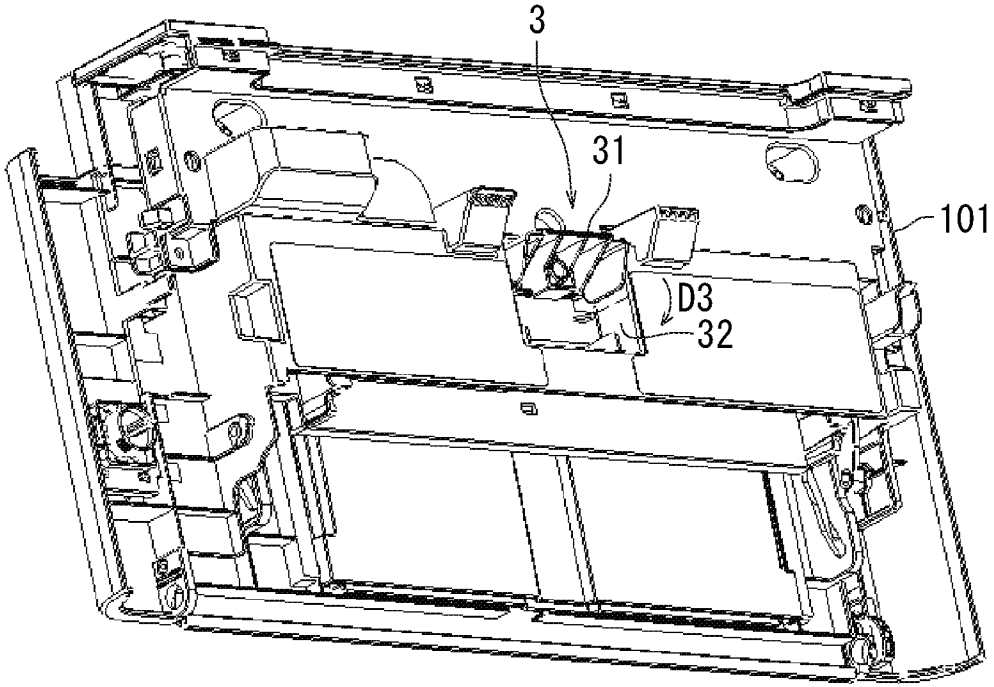
FIG. 9 is a perspective view illustrating an arrangement of a restricting member according to the embodiment of the present disclosure.

Next, a configuration of the restricting member 3 according to the embodiment of the present disclosure is described with reference to FIGS. 1, 2, and 9 to 12. FIG. 9 is a perspective view illustrating an arrangement of the restricting member 3 as seen from the reverse side of the front cover 101. FIG. 9 illustrates a state of the restricting member 3 when the image forming apparatus 100 is manufactured and transported. As illustrated in FIG. 9, the restricting member 3 is located on a central portion of the front cover 101.

The restricting member 3 restricts the front cover 101 from closing. The restricting member 3 includes a rotary member 31 and a recess 32. The rotary member 31 protrudes from the front cover 101 on the reverse surface of the front cover 101. The rotary member 31 is freely rotatable in the direction D3. The recess 32 is recessed into the front cover 101 in a thickness direction thereof. The recess 32 is covered by the rotary member 31 when the rotary member 31 is rotated in the direction D3.

Figure 10:
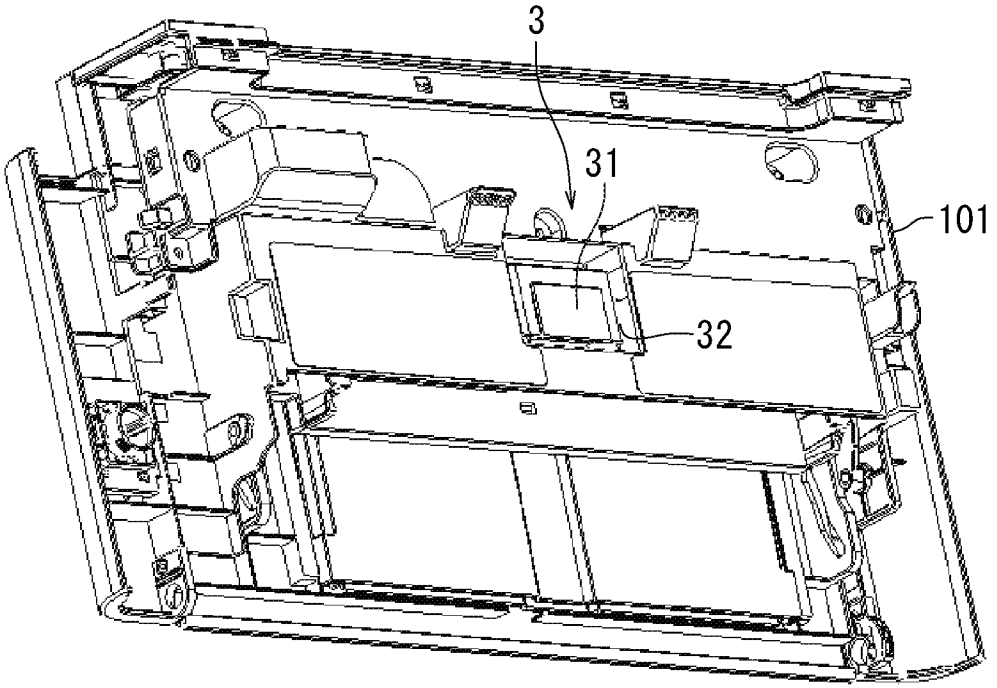
FIG. 10 is a perspective view illustrating the restricting member when the front cover is open.

FIG. 10 is a perspective view illustrating the arrangement of the restricting member 3 as seen from the reverse side of the front cover 101. In FIG. 10, the front cover 101 is open. As illustrated in FIG. 10, the recess 32 of the restricting member 3 is covered by the rotary member 31 when the front cover 101 is open. In the following description, the state of the rotary member 31 protruding from the front cover 101 on the reverse surface of the front cover 101 as illustrated in FIG. 9 may be referred to as the restricting member 3 being in a "protruding state". Also, the state in which the recess 32 is covered by the rotary member 31 as illustrated in FIG. 10 may be referred to as the restricting member 3 being in a "covered state".

Figure 11:
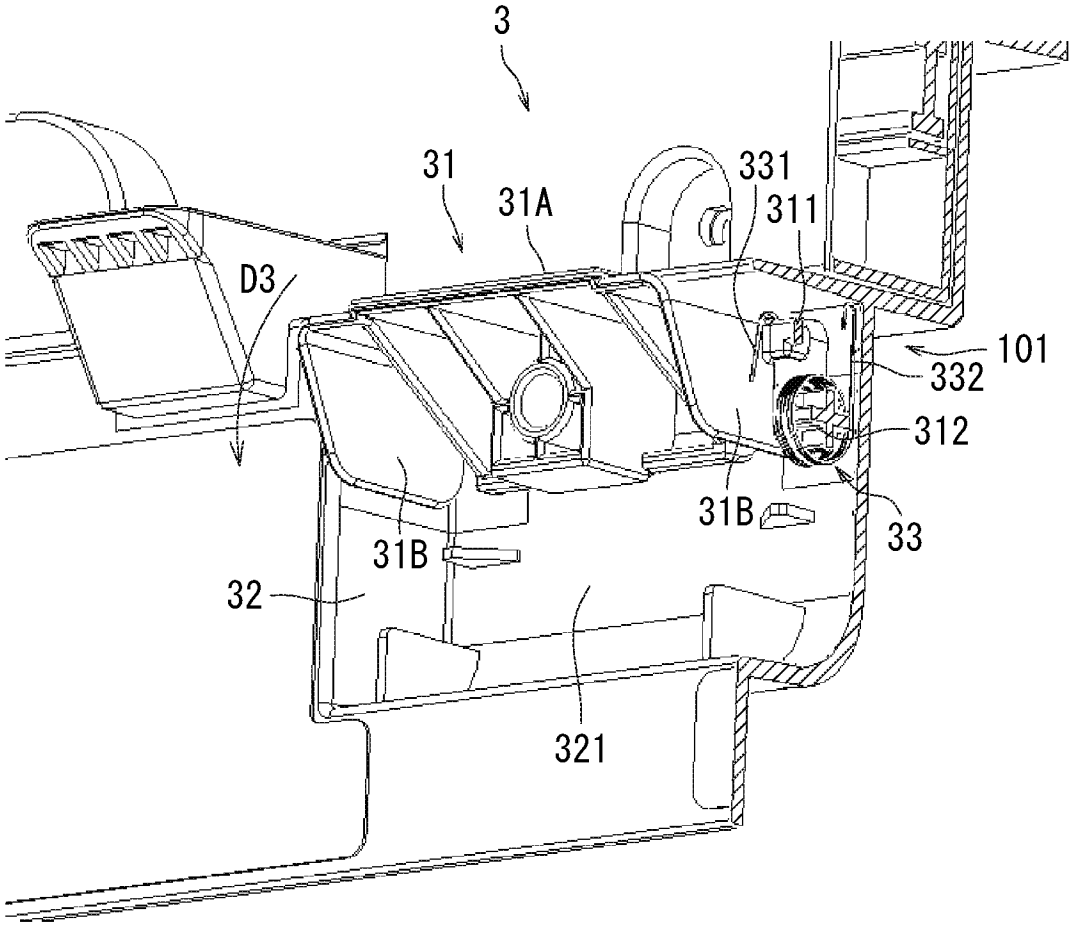
FIG. 11 is a perspective view illustrating a structure of the restricting member.

FIG. 11 is a perspective view illustrating a structure of the restricting member 3. FIG. 11 illustrates a state of the restricting member 3 when the image forming apparatus 100 is manufactured and transported similarly to FIG. 9. As illustrated in FIG. 11, the restricting member 3 further includes an urging member 33. The urging member 33 urges the rotary member 31 in the direction D3. The urging member 33 is a "torsion coil spring", for example. The urging member 33 has an end portion 331 on one side thereof and an end portion 332 on an opposite side thereof.

The rotary member 31 includes a base section 31A, two side plates 31B, a securing member 311, and the supporting member 312. The base section 31A is flatly rectangular plate-shaped and covers the recess 32 when rotated in the direction D3. The two side plates 31B are erected in a direction perpendicular to the base section 31A on respective ends of the base section 31A in a longitudinal direction thereof (left-right direction in FIG. 11). The two side plates 31B are integral with the base section 31A. The securing member 311 and the supporting member 312 are located on one side plate 31B (right in FIG. 11) of the two side plates 31B.

The securing member 311 is located on an end of the one side plate 31B near the base section 31A. The securing member 311 protrudes in a direction away from the other side plate 31B (rightward in FIG. 11). The securing member 311 secures the end portion 331 of one of ends of the urging member 33.

The supporting member 312 is located on an end (lower end in FIG. 11) of the one side plate 31B away from the base section 31A. The supporting member 312 protrudes in a direction away from the other side plate 31B (rightward in FIG. 11). The supporting member 312 rotatably supports the base section 31A and the two side plates 31B. The supporting member 312 supports the urging member 33. Specifically, the supporting member 312 is inserted through a coil portion of the urging member 33.

A base plate 321 is provided to serve as a bottom of the recess 32. The base plate 321 is a plate-shaped member located at the bottom of the recess 32. The end portion 332 of the urging member 33 on the opposite side thereof is secured while in contact with the base plate 321.

The supporting member 312 is inserted through the coil portion of the urging member 33. The end portion 331 of the urging member 33 on the one side thereof is secured to the securing member 311. The end portion 332 of the urging member 33 on the other side thereof is secured while in contact with the base plate 321. In this configuration, the urging member 33 urges the rotary member 31 in the direction D3 through the securing member 311.

Figure 12:
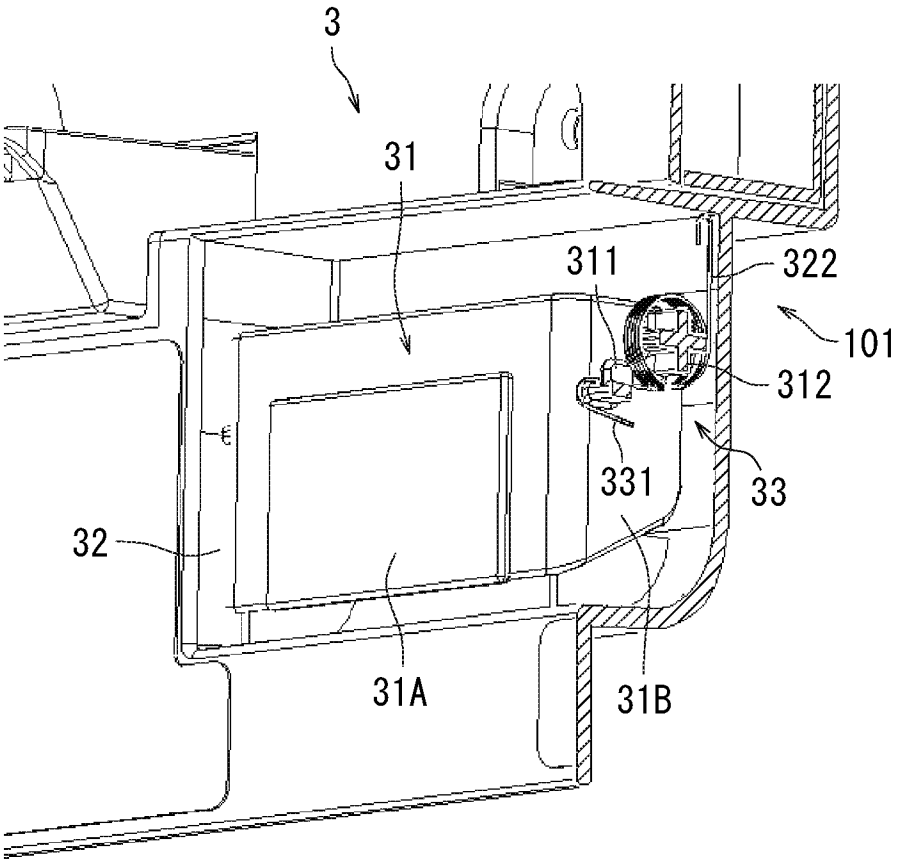
FIG. 12 is a perspective view illustrating the structure of the restricting member.

FIG. 12 is a perspective view illustrating the structure of the restricting member 3. In FIG. 12, the front cover 101 is open. As illustrated in FIG. 12, the recess 32 of the restricting member 3 is covered by the rotary member 31 when the front cover 101 is open. That is, when the rotary member 31 rotates about the supporting member 312 due to the urging member 33 urging the rotary member 31 in the direction D3 as illustrated in FIG. 11, the base section 31A of the rotary member 31 covers the recess 32 as illustrated in FIG. 12. That is, the restricting member 3 changes from the protruding state to the covered state.

Figure 13:
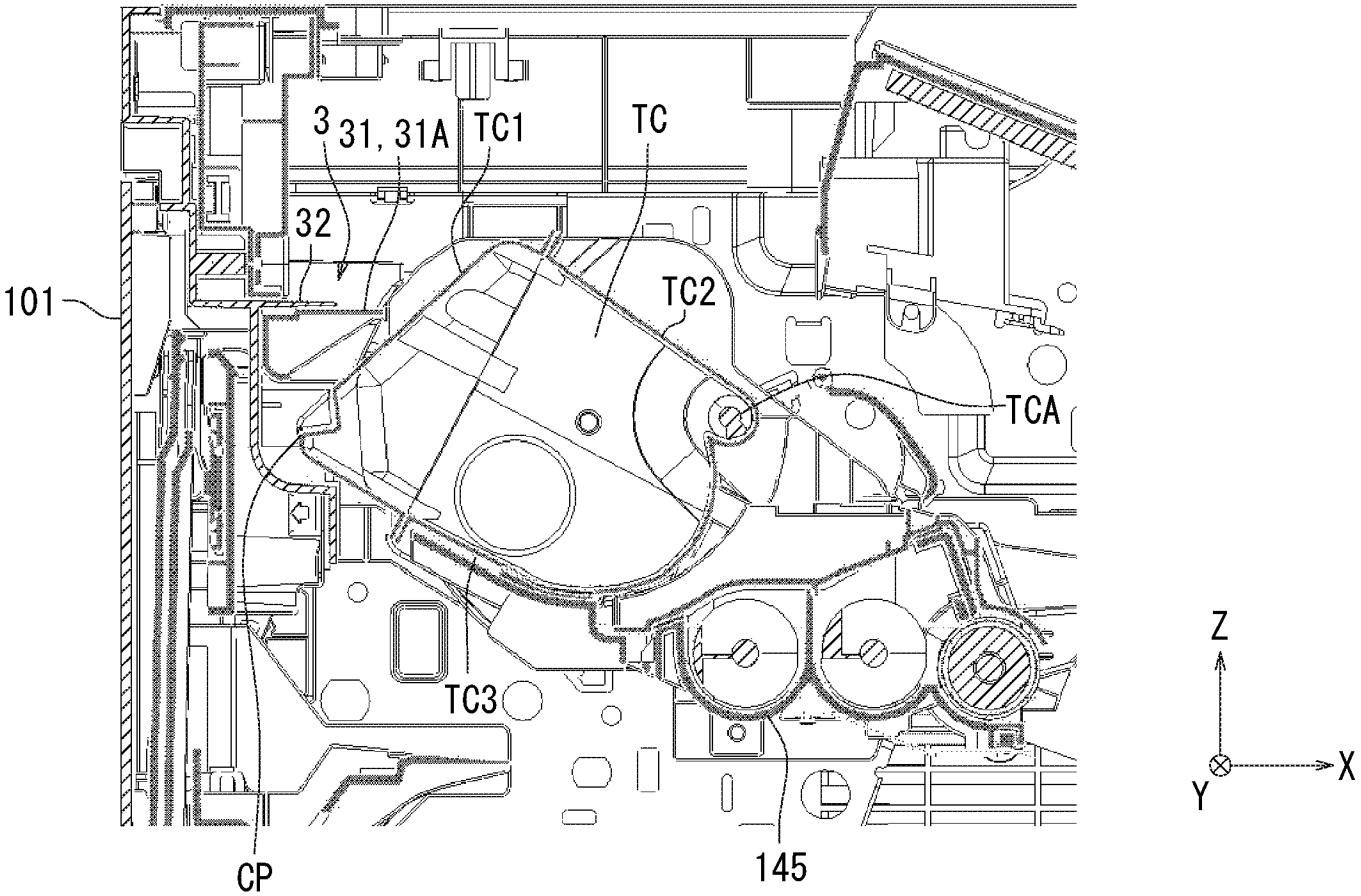
FIG. 13 is a cross-sectional view illustrating the restricting member and a toner container in transport.

Next, a relationship between the restricting member 3 and the toner container TC is described with reference to FIGS. 1, 2, and 9 to 15. FIG. 13 is a cross-sectional view illustrating the restricting member 3 and the toner container TC in transport. As illustrated in FIG. 13, the restricting member 3 is in the protruding state. The toner container TC has a first outer peripheral surface TC1, a second outer peripheral surface TC2, and a third outer peripheral surface TC3.

The first outer peripheral surface TC1 is flatly plate-shaped. The second outer peripheral surface TC2 is flatly plate-shaped. The third outer peripheral surface TC3 is disk-shaped.

One end of the first outer peripheral surface TC1 is connected to the second outer peripheral surface TC2, and an opposite end of the first outer peripheral surface TC1 is connected to the third outer peripheral surface TC3. One end of the second outer peripheral surface TC2 is connected to the first outer peripheral surface TC1, and an opposite end of the second outer peripheral surface TC2 is connected to the third outer peripheral surface TC3. One end of the third outer peripheral surface TC3 is connected to the first outer peripheral surface TC1, and an opposite end of the third outer peripheral surface TC3 is connected to the second outer peripheral surface TC2.

The toner container TC has a toner discharge port TCA. Toner is discharged from the toner container TC through the toner discharge port TCA. A posture of the toner container TC can be changed between a first posture and a second posture. The first posture is a posture in which toner is enabled to be supplied from the toner discharge port TCA of the toner container TC to the image forming section 14 (development section 145). The second posture is a posture in which the toner discharge port TCA is blocked.

The toner container TC illustrated in FIG. 13 takes the second posture. The toner container TC includes a connecting portion CP. The connecting portion CP serves as a peripheral surface of the toner container TC in a position in which the first outer peripheral surface TC1 is connected to the third outer peripheral surface TC3. When the toner container TC is in the second posture, the connecting portion CP is fitted into the recess 32 of the restricting member 3. Therefore, the front cover 101 can be closed even when the toner container TC is in the second posture.

Figure 14:
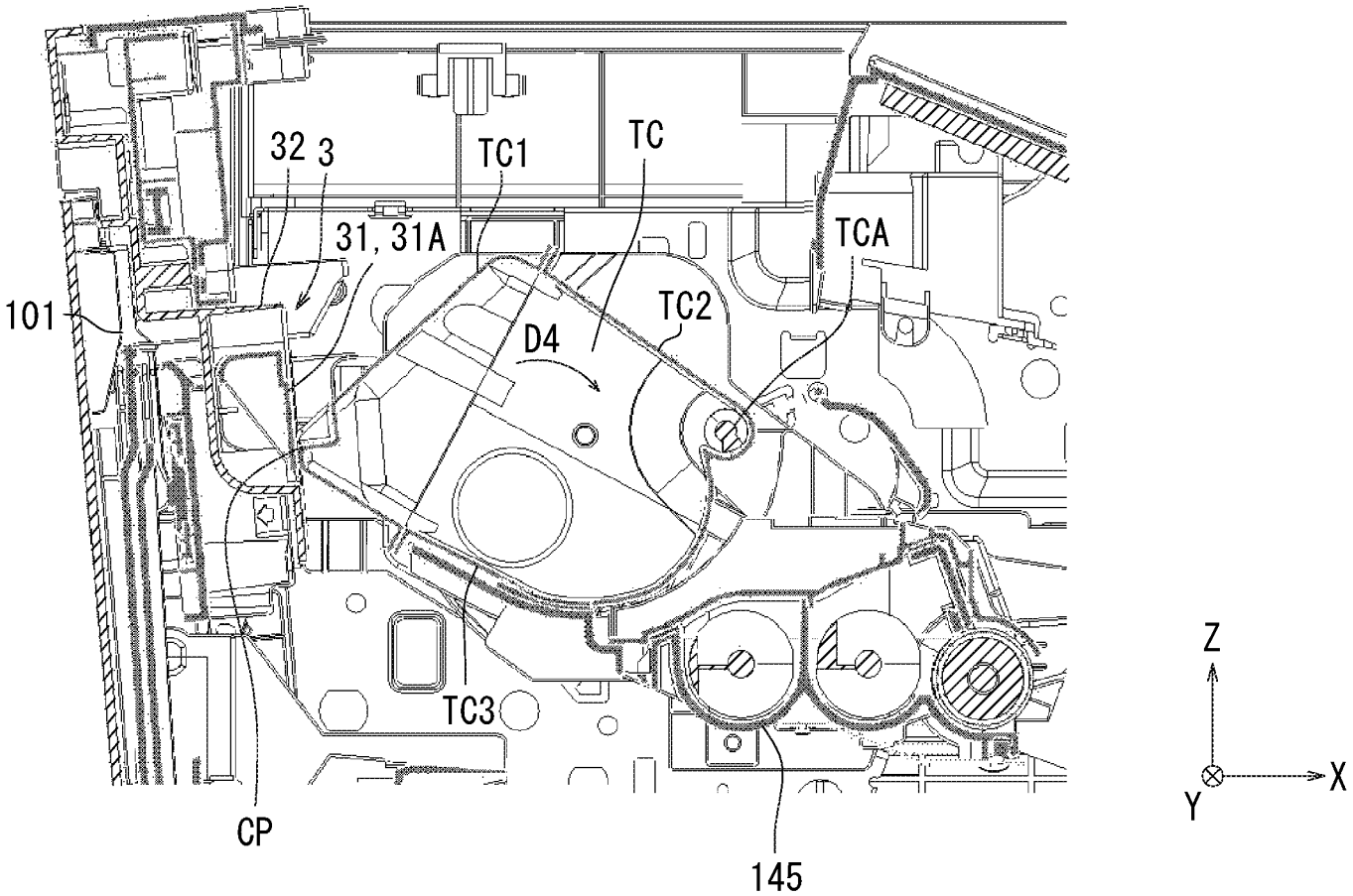
FIG. 14 is a cross-sectional view illustrating the restricting member and the toner container after the front cover is opened.

FIG. 14 is a cross-sectional view illustrating the restricting member 3 and the toner container TC after the front cover 101 is opened. The restricting member 3 illustrated in FIG. 14 is in the covered state, unlike the restricting member 3 as illustrated in FIG. 13. When the front cover 101 is opened as illustrated in FIG. 14, the restricting member 3 is put in the covered state as described with reference to FIGS. 9 to 12. That is, the rotary member 31 (base section 31A) of the restricting member 3 covers the recess 32. When rotating so that the front cover 101 closes, the rotary member 31 makes contact with the connecting portion CP of the toner container TC. As a result, the front cover 101 cannot be closed. That is, when the toner container TC is in the second posture, the restricting member 3 restricts the front cover 101 from closing. Specifically, the restricting member 3 prohibits the front cover 101 from closing.

Figure 15:
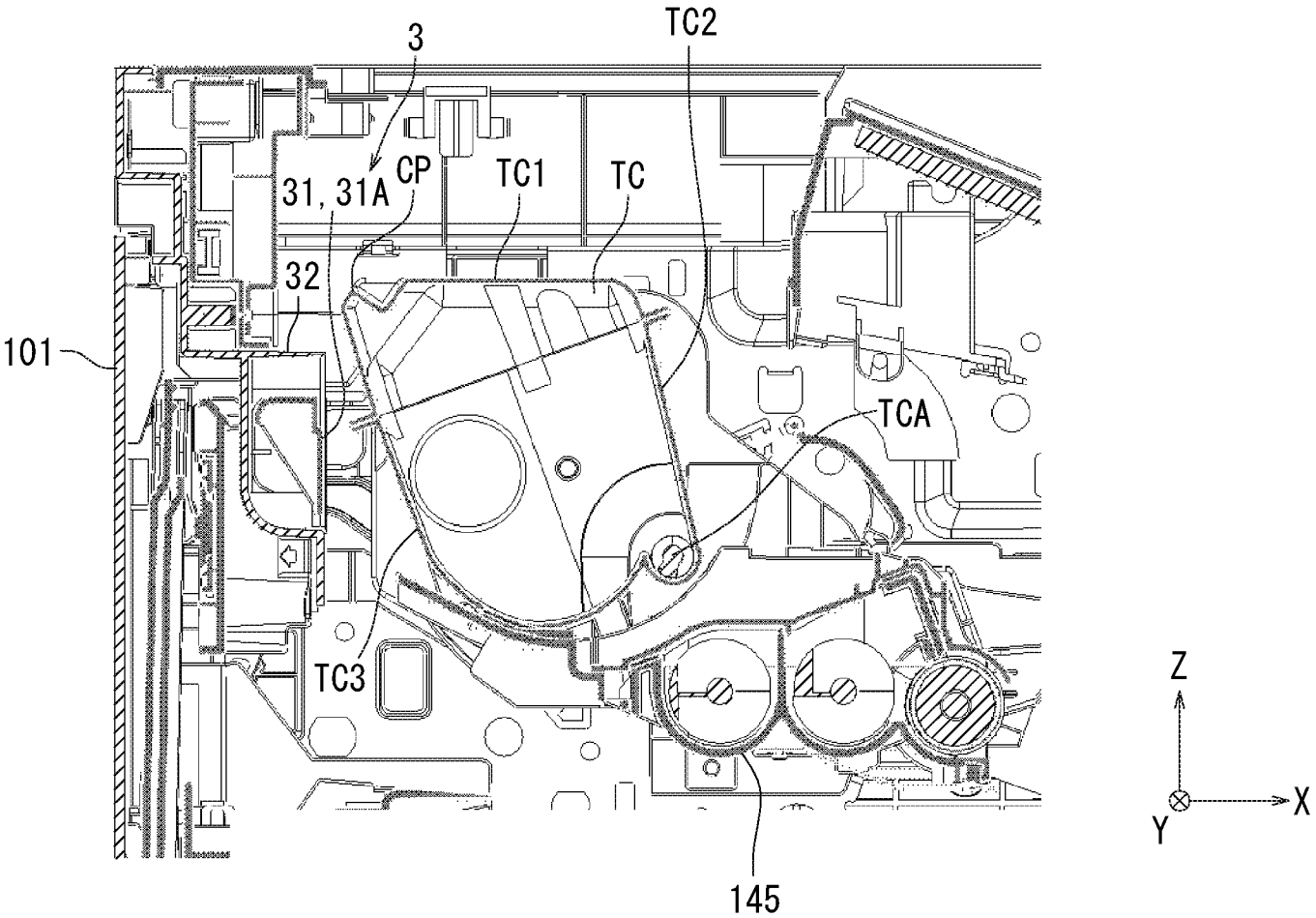
FIG. 15 is a cross-sectional view illustrating the restricting member and the toner container when the front cover is closed.

FIG. 15 is a cross-sectional view illustrating the restricting member 3 and the toner container TC when the front cover 101 is closed. The toner container TC illustrated in FIG. 15 is in the first posture, unlike the toner container TC illustrated in FIG. 14. That is, as illustrated in FIG. 14, the toner container TC is rotated by the user in a direction D4 to change the toner container TC from the second posture illustrated in FIG. 14 to the first posture. When the toner container TC is in the first posture, the first outer peripheral surface TC1 of the toner container TC is parallel to an X-Y plane. When the toner container is in the first posture, the toner can be supplied through the toner discharge port TCA of the toner container TC to the image forming section 14 (development section 145).

Because the toner container TC is in the first posture, the connecting portion CP is positioned above the rotary member 31 of the restricting member 3. Therefore, the front cover 101 can be closed without the rotary member 31 making contact with the connecting portion CP. That is, when the toner container TC is in the first posture, the restricting member 3 allows the front cover 101 to close.

In the embodiment of the present disclosure as described above with reference to FIGS. 1, 2, and 9 to 15, when the toner container TC is in the first posture, the restricting member 3 allows the front cover 101 to close. When the toner container TC is in the second posture, the restricting member 3 prohibits the front cover 101 from closing. Therefore, the user must change the toner container TC from the second posture to the first posture to close the front cover 101. Accordingly, the user can be led to put the toner container TC in the first posture.

Figure 16A:
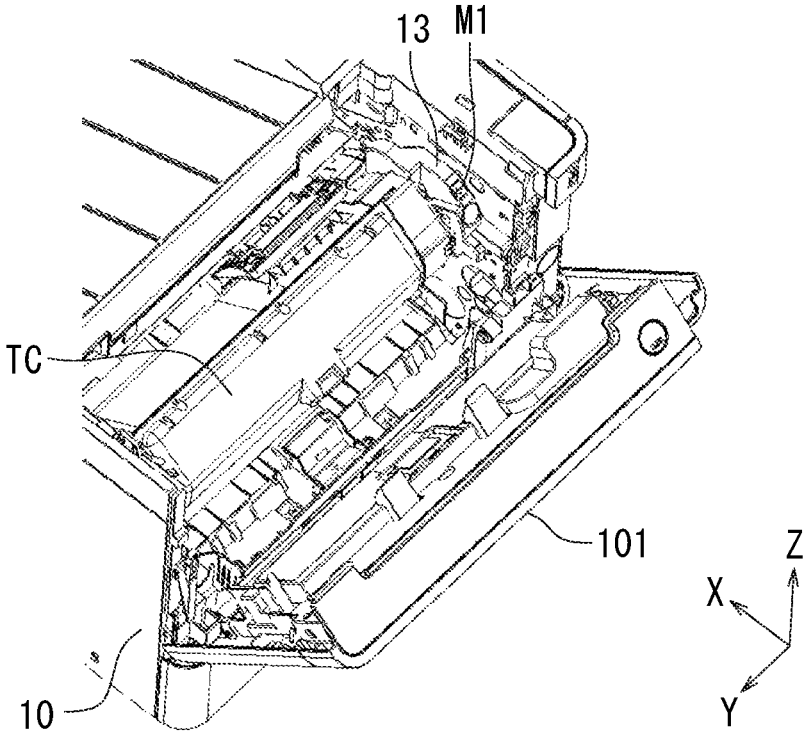
FIG. 16A is a perspective view illustrating an arrangement of posture displaying members when the toner container is in a second posture.
Figure 16B:
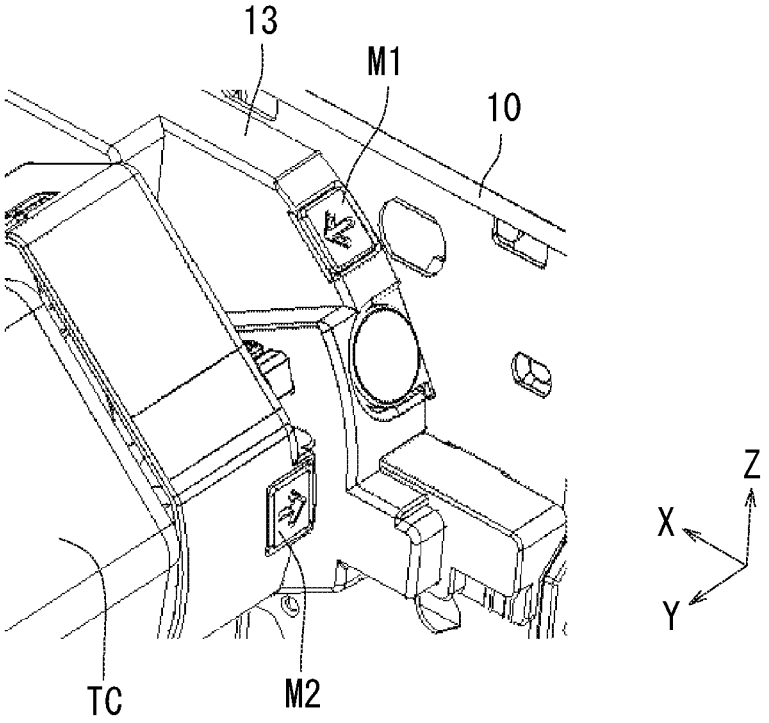
FIG. 16B is an enlarged perspective view illustrating the arrangement of the posture displaying members when the toner container is in the second posture.

Next, a configuration of a posture displaying member M1 and a posture displaying member M2 is described with reference to FIGS. 1, 2, 16A, 16B, 17A, and 17B. FIG. 16A is a perspective view illustrating an arrangement of the posture displaying members M1 and M2 when the toner container TC is in the second posture. FIG. 16B is an enlarged perspective view illustrating the arrangement of the posture displaying members M1 and M2 when the toner container TC is in the second posture. As illustrated in FIGS. 16A and 16B, the image forming apparatus 100 further includes the posture displaying member M1. The posture displaying member M1 is located on the toner supply section 13. Specifically, the posture displaying member M1 is located adjacent to an end of the toner container TC in the negative Y axis direction on the toner supply section 13. The posture displaying member M1 faces aslant by 45° in the X axis direction from the Z axis in the X-Z plane.

As illustrated in FIG. 16B, the toner container TC further includes the posture displaying member M2. The posture displaying member M2 is located on an end (upper right end in FIG. 16B) of the toner container TC near the posture displaying member M1 of the toner supply section 13. When the toner container TC is in the second posture, the posture displaying member M2 is located lower than a position opposite to the posture displaying member M1. Therefore, when the posture displaying member M2 is located beneath the posture displaying member M1, the posture displaying member M1 and the posture displaying member M2 indicate that the toner container TC is in the second posture. The posture displaying member M1 and the posture displaying member M2 constitute an example of a second displaying member.

Figure 17A:
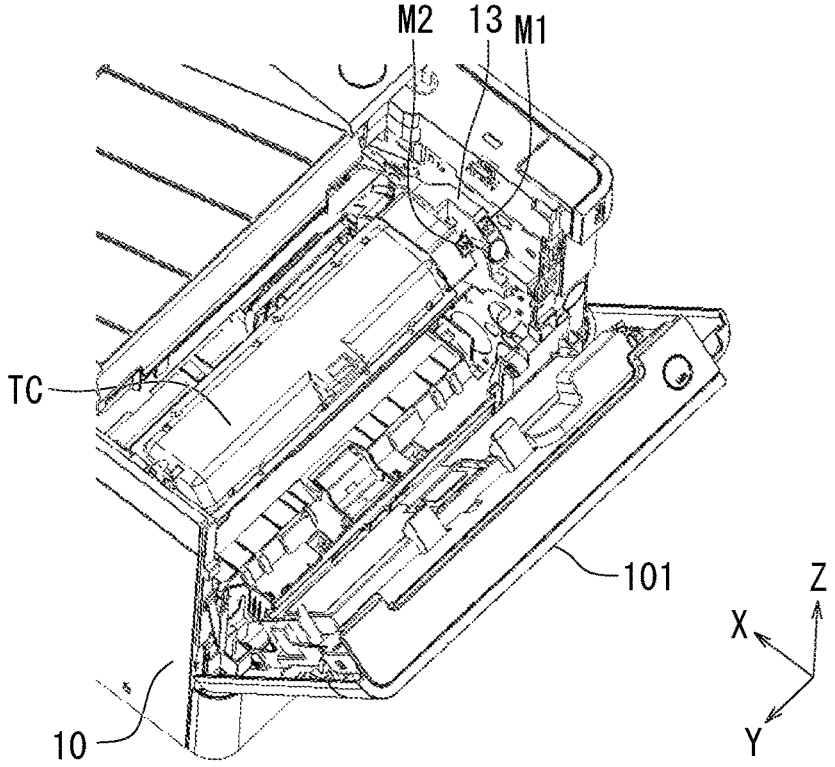
FIG. 17A is a perspective view illustrating the arrangement of the posture displaying members when the toner container is in a first posture.
Figure 17B:
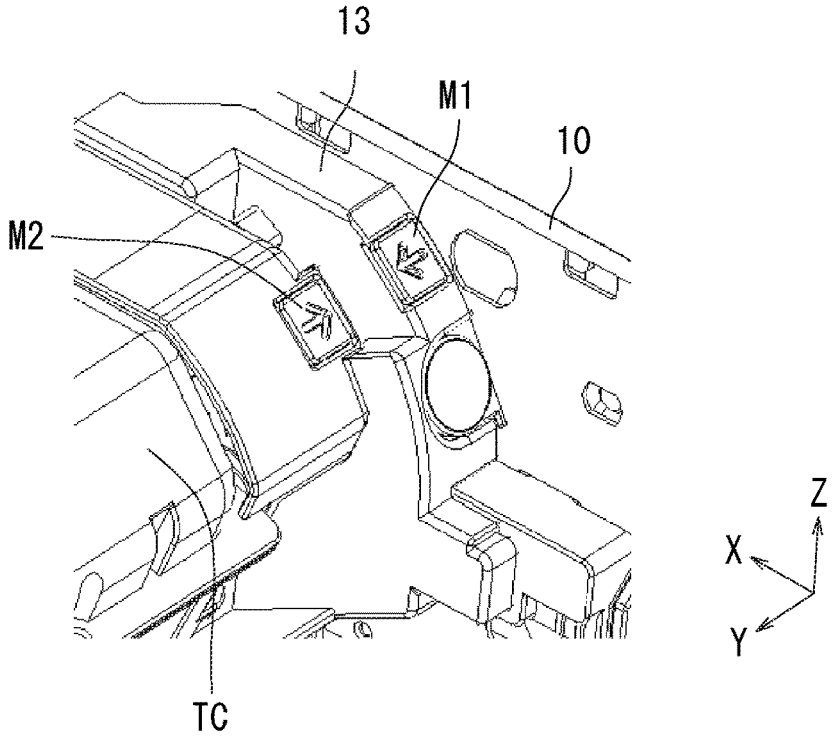
FIG. 17B is an enlarged perspective view illustrating the arrangement of the posture displaying members when the toner container is in the first posture.

FIG. 17A is a perspective view illustrating an arrangement of the posture displaying members M1 and M2 when the toner container TC is in the first posture. FIG. 17B is an enlarged perspective view illustrating the arrangement of the posture displaying members M1 and M2 when the toner container TC is in the first posture. As illustrated in FIGS. 17A and 17B, when the toner container TC is in the first posture, the posture displaying member M2 is located opposite to the posture displaying member M1. Therefore, when the posture displaying member M2 is located opposite to the posture displaying member M1, the posture displaying member M1 and the posture displaying member M2 indicate that the toner container TC is in the first posture.

As described above with reference to FIGS. 1, 2, 16A, 16B, 17A, and 17B, the toner container TC is attachable and detachable when the front cover 101 is open. Therefore, the position of the toner container TC can be adjusted when the front cover 101 is open. Accordingly, the toner container TC can be changed from the second posture to the first posture.

The posture displaying member M1 and the posture displaying member M2 indicate whether the toner container TC is in the first posture or the second posture. Therefore, the user can ascertain whether the toner container TC is in the first posture or the second posture. Accordingly, the user can be led to put the toner container TC in the first posture.

The embodiment of the present disclosure has been described so far with reference to the accompanying drawings. However, the present disclosure is not limited to the above-described embodiment and may be implemented in various manners within a scope not departing from the gist thereof (as below in (1) to (3), for example). The drawings are schematic illustrations that emphasize elements of configuration in order to facilitate understanding thereof. Properties of the elements of configuration illustrated in the drawings, such as thickness, length, and number thereof, may differ from actual properties thereof in order to facilitate preparation of the drawings. Properties of the elements of configuration illustrated in the above-described embodiment such as shape and size are examples, not particularly limited, and may be variously altered within a scope not substantially departing from the configuration of the present disclosure.

(1) As described with reference to FIG. 1, the image forming apparatus 100 is a printer, but the present disclosure is not limited as such. It is only required that the image forming apparatus 100 include the image forming section 14. For example, the image forming apparatus 100 may be a multifunction peripheral. For another example, the image forming apparatus 100 may be a copier.

(2) As described with reference to FIGS. 1 to 3, the power supply lock structure 2 is located on the front cover 101, but the present disclosure is not limited as such. It is only required that the power supply lock structure 2 be located on a cover. For example, the power supply lock structure 2 may be located on a back cover. For another example, the power supply lock structure 2 may be located on an upper cover.

(3) As described with reference to FIGS. 3 to 8, the locking mechanism 20 prohibits the operation of the power button 21 by prohibiting movement of the shaft member 212 in the axial direction of the shaft member 212, but the present disclosure is not limited as such. It is only required that the locking mechanism 20 prohibit the operation of the power button 21. For example, the locking mechanism 20 may open a power supply circuit.

What is claimed is:

1. A power supply lock structure, comprising:

a power button configured to switch a power supply between on and off; and a locking mechanism configured to prohibit operation of the power button, wherein the power button is located on an obverse surface of a cover, and the locking mechanism is located on a reverse surface of the cover, and prohibition of the operation of the power supply is releasable by the locking mechanism only when the cover is open.

2. The power supply lock structure according to claim 1, wherein the power button includes:

a button; and a shaft member that supports the button, the button is secured to one end of the shaft member, and the locking mechanism prohibits movement of the shaft member in an axial direction of the shaft member.

3. The power supply lock structure according to claim 2, wherein the locking mechanism includes:

a rotary member that rotates together with the shaft member about an axis of the shaft member as a center; and a supporting member that rotatably supports the rotary member, the shaft member is inserted through the rotary member, the supporting member is secured to the cover, the supporting member has a protruding member that protrudes toward an outer periphery of the rotary member, the rotary member includes an engaging member that engages with the protruding member, and when the engaging member engages with the protruding member, movement of the shaft member in the axial direction of the shaft member is prohibited.

4. The power supply lock structure according to claim 3, wherein the locking mechanism further includes a first displaying member that indicates whether the rotary member is in a first rotational position or a second rotational position, when the rotary member is in the first rotational position, movement of the shaft member in the axial direction of the shaft member is prohibited, and when the rotary member is in the second rotational position, prohibition of movement of the shaft member in the axial direction of the shaft member is released.

5. An image forming apparatus, comprising:

a power supply lock structure;

an image forming section configured to form an image on a recording medium; and a casing including a cover and configured to house the image forming section, wherein the power supply lock structure includes:

a power button located on an obverse surface of the cover and configured to switch a power supply between on and off; and a locking mechanism located on an reverse surface of the cover and configured to prohibit operation of the power supply by the power button, and prohibition of the operation of the power supply is releasable by the locking mechanism only when the cover is open.

6. The image forming apparatus according to claim 5, wherein a toner container is attachable to and detachable from the image forming section, and when the cover is open, the toner container is attachable and detachable.

7. The image forming apparatus according to claim 6, further comprising a restricting member located on the cover and configured to restrict the cover from closing, wherein the toner container has a toner discharge port that discharges toner, a posture of the toner container is changeable between a first posture and a second posture, the first posture is a posture that enables the toner to be supplied through the toner discharge port to the image forming section, the second posture is a posture in which the toner discharge port is blocked, and the restricting member allows the cover to close when the toner container is in the first posture, and restricts the cover from closing when the toner container is in the second posture.

8. The image forming apparatus according to claim 7, further comprising a second displaying member configured to indicate whether the toner container is in the first posture or the second posture.

* * * * *